US010577772B1

(12) United States Patent
Taylor

(10) Patent No.: US 10,577,772 B1
(45) Date of Patent: Mar. 3, 2020

(54) SOIL REINFORCING ELEMENTS FOR MECHANICALLY STABILIZED EARTH STRUCTURES

(71) Applicant: Big R Manufacturing, LLC, Greeley, CO (US)

(72) Inventor: Thomas P. Taylor, Colleyville, TX (US)

(73) Assignee: BIG R MANUFACTURING, LLC, Greeley, CO (US)

( * ) Notice: Subject to any disclaimer, the term of this patent is extended or adjusted under 35 U.S.C. 154(b) by 0 days.

(21) Appl. No.: 16/275,154

(22) Filed: Feb. 13, 2019

(51) Int. Cl.
*E02D 29/02* (2006.01)
*E02D 5/80* (2006.01)

(52) U.S. Cl.
CPC ..... *E02D 29/0233* (2013.01); *E02D 5/801* (2013.01); *E02D 29/0266* (2013.01); *E02D 2200/13* (2013.01); *E02D 2600/30* (2013.01)

(58) Field of Classification Search
CPC ..... E02D 29/0225; E02D 29/0233
USPC ..... 405/262
See application file for complete search history.

(56) References Cited

U.S. PATENT DOCUMENTS 3,421,326 A * 1/1969 Vidal ..... E02B 3/06 405/284
4,324,508 A * 4/1982 Hilfiker ..... E02D 29/0241 405/262
4,834,584 A * 5/1989 Hilfiker ..... E02D 29/0241 405/262
4,993,879 A * 2/1991 Hilfiker ..... E02D 29/0225 403/207
5,407,303 A * 4/1995 Manns ..... E02D 29/0225 405/262
5,890,843 A * 4/1999 Bastick ..... E02D 17/20 405/259.1
6,565,288 B1 * 5/2003 McCallion ..... E02D 5/74 405/259.5
8,079,782 B1 * 12/2011 Hilfiker ..... E02D 29/0233 405/262
8,182,177 B2 * 5/2012 Morizot ..... E02D 29/0241 405/262
8,734,059 B2 * 5/2014 Taylor ..... E02D 29/0225 405/262
8,967,917 B1 * 3/2015 Hilfiker, Jr. ..... E02D 29/02 405/262
9,011,048 B2 * 4/2015 Hilfiker ..... E02D 17/18 405/284
9,267,259 B2 * 2/2016 Taylor ..... E02D 29/02
2004/0109729 A1 * 6/2004 Hilfiker ..... B21C 37/20 405/262
2006/0204342 A1 * 9/2006 Hilfiker ..... E02D 29/0241 405/262

FOREIGN PATENT DOCUMENTS

JP 57130630 A * 8/1982 ..... E02D 17/202

* cited by examiner

*Primary Examiner* — Frederick L Lagman
(74) *Attorney, Agent, or Firm* — Nolte Intellectual Property Law Group

(57) ABSTRACT

A soil reinforcing element for use in a mechanically stabilized earth structure. The soil reinforcing element may include a longitudinal wire including a helical portion and a connection element disposed at a first end of the longitudinal wire and configured to couple to a facing of the mechanically stabilized earth structure. The helical portion included in the longitudinal wire may introduce extensibility to the longitudinal wire under loading conditions.

21 Claims, 5 Drawing Sheets

SOIL REINFORCING ELEMENTS FOR MECHANICALLY STABILIZED EARTH STRUCTURES

BACKGROUND

Retaining wall structures that use soil inclusions to reinforce an earth mass are generally referred to as mechanically stabilized earth (MSE) structures. MSE structures can be used for various applications including retaining walls, bridge abutments, dams, seawalls, and dikes.

Typically, the soil inclusions utilized in MSE structures include horizontally positioned reinforcing elements that are layered with soil, much like a layer cake. Layers of backfill (soil) and horizontally positioned reinforcing elements are positioned one atop the other and compacted until a desired height and shape of the earthen structure is achieved. Traditionally, the horizontally positioned reinforcing elements may include grid-like steel mats, welded wire mesh or strips. At times, the reinforcing elements may be attached to a substantially vertical wall that either forms part of the MSE structure or is offset a short distance therefrom. The wall may be concrete or a steel wire facing, and the soil reinforcing elements may be attached directly to the wall in a variety of configurations. The vertical wall provides resistance to the soil reinforcing elements and prevents erosion of the MSE structure.

Soil reinforcing elements may be categorized as inextensible or extensible depending on the type of material of the soil reinforcing elements. Inextensible soil reinforcing elements deformation at failure is much less than the deformability of the soil. Extensible soil reinforcing at failure is comparable to or even greater than the deformability of the soil. Inextensible soil reinforcing elements are generally constructed of metal, resulting in stiffer and more durable soil reinforcing elements. Extensible soil reinforcing elements are generally constructed from polymeric material. While strength and durability of soil reinforcing elements are desired, it is beneficial for soil reinforcing elements to have more ductility because when the soil is allowed to displace, the load in the soil decreases.

Accordingly, it is desirable to provide extensibility into inextensible reinforcing elements. What is needed, therefore, are improved systems and methods for providing extensibility into inextensible soil reinforcing elements of MSE structures.

SUMMARY

Embodiments of the present disclosure may include a soil reinforcing element for use in a mechanically stabilized earth structure. The soil reinforcing element may include a longitudinal wire including a first helical portion and configured to couple to a facing of the mechanically stabilized earth structure.

Embodiments of the present disclosure may also include a soil reinforcing element for use in a mechanically stabilized earth structure. The soil reinforcing element may include a first longitudinal wire, a second longitudinal wire, a plurality of transverse wires, and a connection element. The first longitudinal wire may include a first helical portion. The second longitudinal wire may be disposed substantially parallel to the first longitudinal wire and include a first helical portion. The plurality of transverse wires may be disposed substantially perpendicular to and coupled to the first longitudinal wire and the second longitudinal wire. The connection element may be disposed at a first end of each of the first longitudinal wire and the second longitudinal wire and configured to couple to a facing of the mechanically stabilized earth structure.

Embodiments of the present disclosure may further include a system for constructing a mechanically stabilized earth structure. The system may include a facing and a soil reinforcing element. The soil reinforcing element may be configured to extend from the facing into a backfill. The soil reinforcing element may include a longitudinal wire including a first helical portion and a connection element. The connection element may be disposed at a first end of the longitudinal wire and configured to couple to the facing of the mechanically stabilized earth structure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
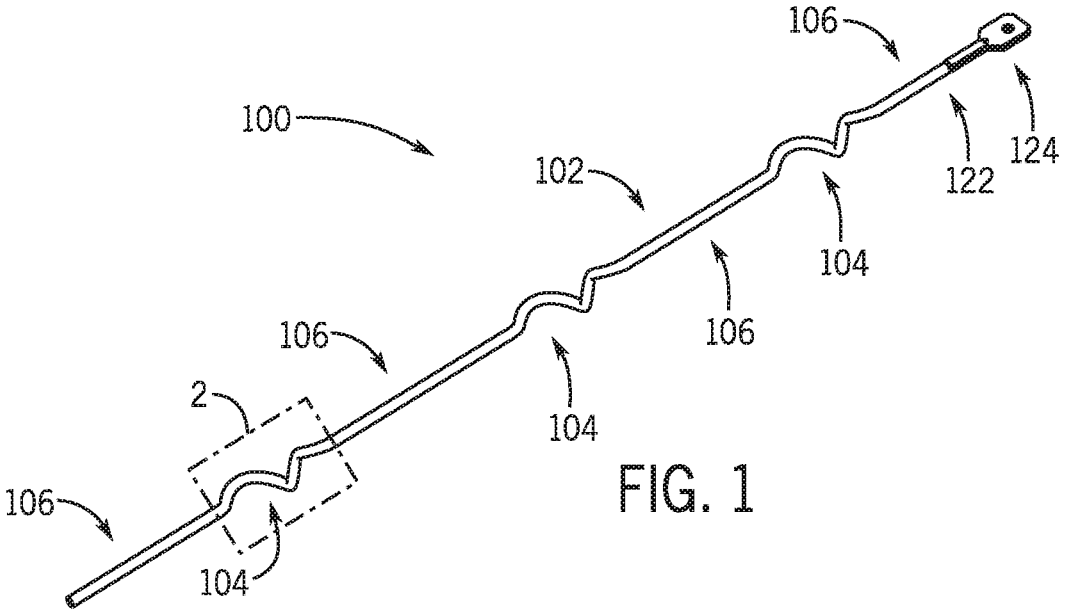
FIG. 1 is a perspective view of a soil reinforcing element for use in a mechanically stabilized earth ("MSE") structure, according to one or more embodiments of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Embodiments of the disclosure generally provide an inextensible soil reinforcing element to be used in systems for constructing an MSE structure that includes at least one longitudinal wire having one or more helical portions. As constructed, the helical portion(s) may introduce extensibility to the inextensible soil reinforcing element under loading conditions. In some embodiments, the inextensible soil reinforcing element may include at least two longitudinal wires each having one or more helical portions, where the longitudinal wires are coupled to one or more transverse wires. A plurality of these soil reinforcing elements may be coupled together to form a wire mesh system that may extend under load.

Figure 2:
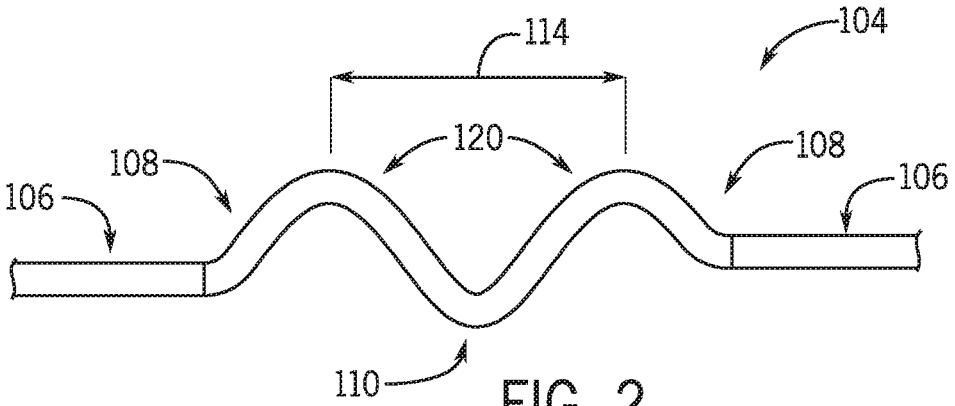
FIG. 2 is a side view of a portion of the soil reinforcing element indicated by the detailed labeled 2 in FIG. 1.
Figure 3:
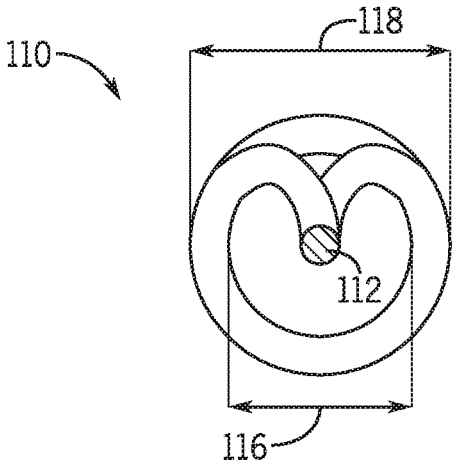
FIG. 3 is a front view of the portion of the soil reinforcing element indicated by the detailed labeled 2 in FIG. 1.

Turning now to the drawings, FIG. 1 is a perspective view of a soil reinforcing element 100 for use in a system for constructing an MSE structure, according to one or more embodiments of the disclosure. FIG. 2 and FIG. 3 are respective side and front views of a portion of the soil reinforcing element 100 indicated by the detail labeled 2 in FIG. 1. The soil reinforcing element 100 may include a longitudinal wire 102 having one or more helical portions 104 (three shown). As shown in FIG. 1, each helical portion 104 may be separated from one another by a linear portion 106 of the longitudinal wire 102. Each linear portion 106 may be a straight or substantially straight portion of the longitudinal wire 102 in one or more embodiments.

As shown most clearly in FIG. 2, each helical portion 104 may be coupled to a respective linear portion 106 of the longitudinal wire 102 at each end 108 of the helical portion 104. In one or more embodiments, each helical portion 104 may be resistance welded to a respective linear portion 106 at each end of the helical portion 104. Such a coupling may be referred to as a butt weld by one of ordinary skill in the art and may be implemented utilizing stationary and movable clamps (not shown) while applying a force to at least one of the linear portions 106 and the helical portion 104. Although coupling of the helical portion 104 and linear portions 106 may be carried out by welding, and in some examples by butt welding, the present disclosure is not limited thereto. Other known manners of coupling including brazing, mechanical fasteners, and the like may be implemented without departing from the scope and spirit of the present disclosure. Additionally, in some embodiments, the linear portions 106 and helical portions 104 may be integral with one another (i.e., formed from manipulation of a single longitudinal wire 102).

Each helical portion 104 and each linear portion 106 of the longitudinal wire 102 may be constructed, for example, from steel or a metal alloy. Accordingly, the soil reinforcing element 100 may be considered inextensible. However, the helical portions 104 included in the longitudinal wire 102 may introduce some extensibility under loading conditions. Specifically, as the forces in the MSE structure increase, the helical portions 104 gradually extend and deform resulting in a decreased force within the MSE soil. Because the soil may be allowed to displace, the horizontal pressure in the soil decreases and the required metal or steel density of the MSE structure decreases.

Each helical portion 104 may be a portion of the longitudinal wire 102 forming at least one coil 110 (two shown most clearly in FIG. 2) rotated about a center axis 112. Each coil 110 may be one complete rotation of the longitudinal wire 102 about the center axis 112. To that end, each coil 110 may have a pitch 114, an inner diameter 116 (FIG. 3), and an outer diameter 118 (FIG. 3). The pitch 114 of each coil 110 may be the axial distance between each end 120 of the coil 110. The pitch 114 and the outer diameter 118 of each coil 110 in the helical portions 104 may be the same in the soil reinforcing element 100, as illustrated in FIG. 1. However, in other embodiments, the pitch 114, the outer diameter 118, or both the pitch 114 and the outer diameter 118 of one or more coils 110 in a helical portion 104 may be different from at least one coil 110 in another helical portion 104 of the soil reinforcing element 100.

The longitudinal wire 102 may further include a lead end 122 configured to couple to a connection element. In turn, the connection element may be configured to be coupled to a substantially vertical wall (e.g., facing 702 or 802 in FIGS. 7 and 8) that either forms part of the MSE structure or is offset a short distance therefrom. As illustrated in FIG. 1, the lead end 122 is coupled to a connection element, illustrated as a connection stud 124. Although illustrated as a connection stud 124, in other embodiments, the connection element may be a bent portion of the lead end 122 or any other element suitable for connection with the substantially vertical wall.

Figure 4:
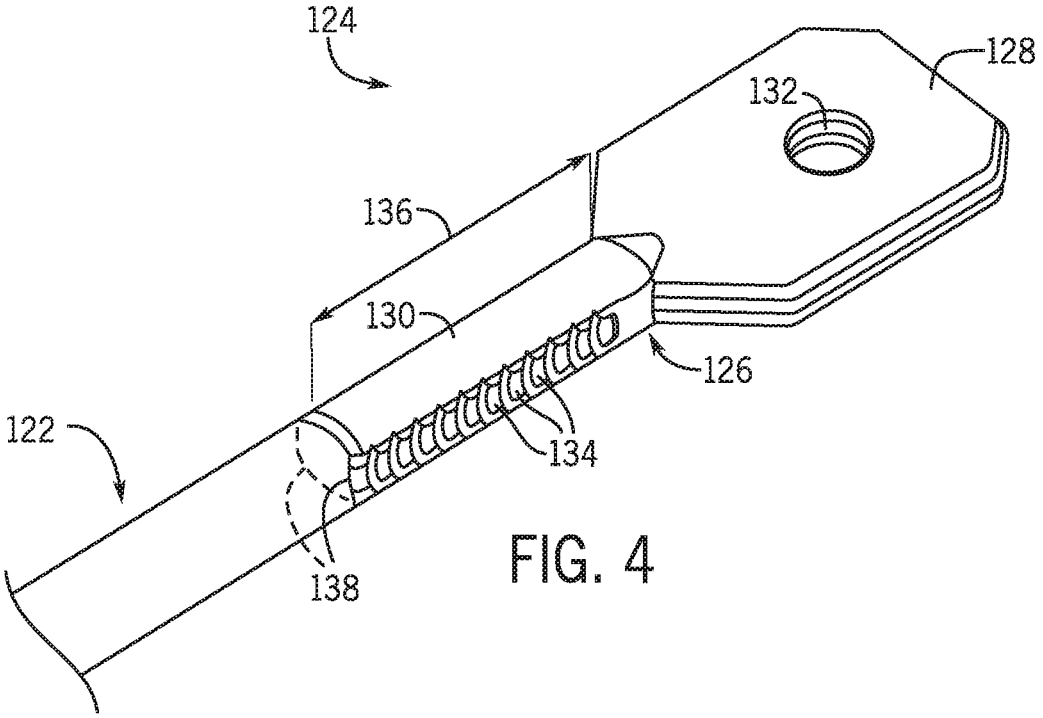
FIG. 4 is a perspective view of the connection stud of the soil reinforcing element illustrated in FIG. 1, according to one or more embodiments.

Referring now to FIG. 4 with continued reference to FIG. 1, FIG. 4 is a perspective view of the lead end 122 coupled to the connection stud 124. In one or more embodiments, the lead end 122 may be resistance welded to the connection stud 124. The connection stud 124 may include a first end or a stem 126 and a second end or a tab 128. In some embodiments, the stem 126 and the tab 128 may be integral with one another (i.e., formed from a one-piece forging process). In other embodiments, however, the connection stud 124 can be created by welding or otherwise attaching the stem 126 to the tab 128. In at least one embodiment, the stem 126 may include a cylindrical body 130. As illustrated, the lead end 122 may be coupled or otherwise attached to the stem 126. In one embodiment, the tab 128 may be a substantially planar plate and define at least one centrally-located perforation or hole 132.

As most clearly shown in FIG. 4, the stem 126 may include a plurality of indentations or grooves 134 defined along its axial length 136. In one embodiment, the grooves 134 may be cast or otherwise machined into the stem 126.

In other embodiments, the grooves 134 can include standard thread markings machined along the axial length 136 of the stem 126. As will be further discussed below with reference to FIG. 6, the grooves 134 may provide a more suitable welding surface for attaching the lead ends 122 of the longitudinal wires 102 thereto, thereby resulting in a stronger resistance weld.

As illustrated in FIG. 4, the stem 126 may include an axial channel 138 (one shown) extending along the axial length 136 on opposing sides. In other embodiments, the axial channels 138 may extend along the axial length 136 on adjacent sides or at any location on the stem 136. In at least one embodiment, the axial channels 138 may be formed during a casting or forging process. In other embodiments, however, the axial channels 138 may be generated by applying longitudinal pressure to the opposing sides of the stem 126 with a cylindrical die or the like (not shown). The axial channels 138 may include the grooves 134 machined or otherwise formed therein. The grooves 134 may be generated during the forging process, or via the cylindrical die that forms the axial channels 138. In other embodiments, however, the grooves 134 may be subsequently machined into the axial channels 138 after a forging process and/or the application of a cylindrical die. As can be appreciated with reference to FIG. 4, the axial channels 138 may provide an added amount arcuate surface area to weld the lead ends 122 of the longitudinal wires 102 to, thereby creating a more solid resistance weld. Moreover, because of the added amount of arcuate surface area, the axial channels 138 may serve to protect the resistance weld from corrosion over time.

Figure 5:
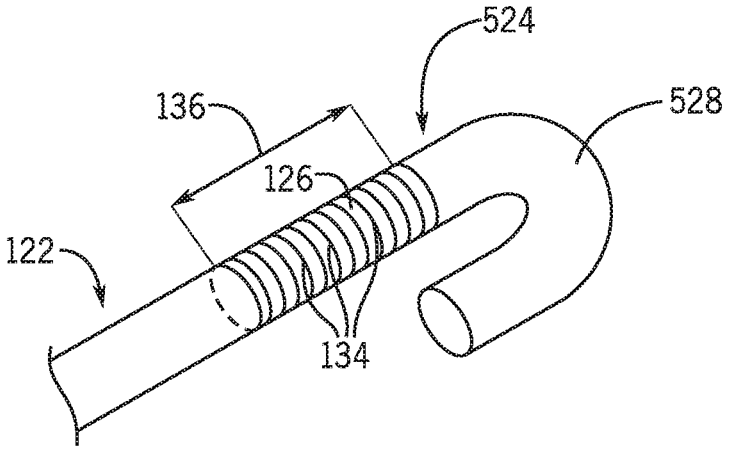
FIG. 5 is a perspective view of another connection stud that may be included in the soil reinforcing element of FIG. 1, according to one or more embodiments.

Turning now to FIG. 5, FIG. 5 is a perspective view of an alternate connection stud 524 coupled to the lead end 122 of the soil reinforcing element 100, according to one or more embodiments of the disclosure. As the connection stud 524 may have similar features to the connection stud 124 of FIGS. 1-4, like numerals will be used to denote like elements, which will not be discussed in detail again for the sake of brevity. The connection stud 524 may include a first end or stem 126 and a second end or connector 528. As illustrated, the stem 126 may include a plurality of indentations or grooves 134 defined along its axial length 136. In one or more embodiments, the connector 528 may be hook-shaped and bent or otherwise turned about 180° from the axial direction of the stem 126 and adapted to couple or otherwise attach to the wire facing 802, as will be described below in FIG. 8.

Figure 6:
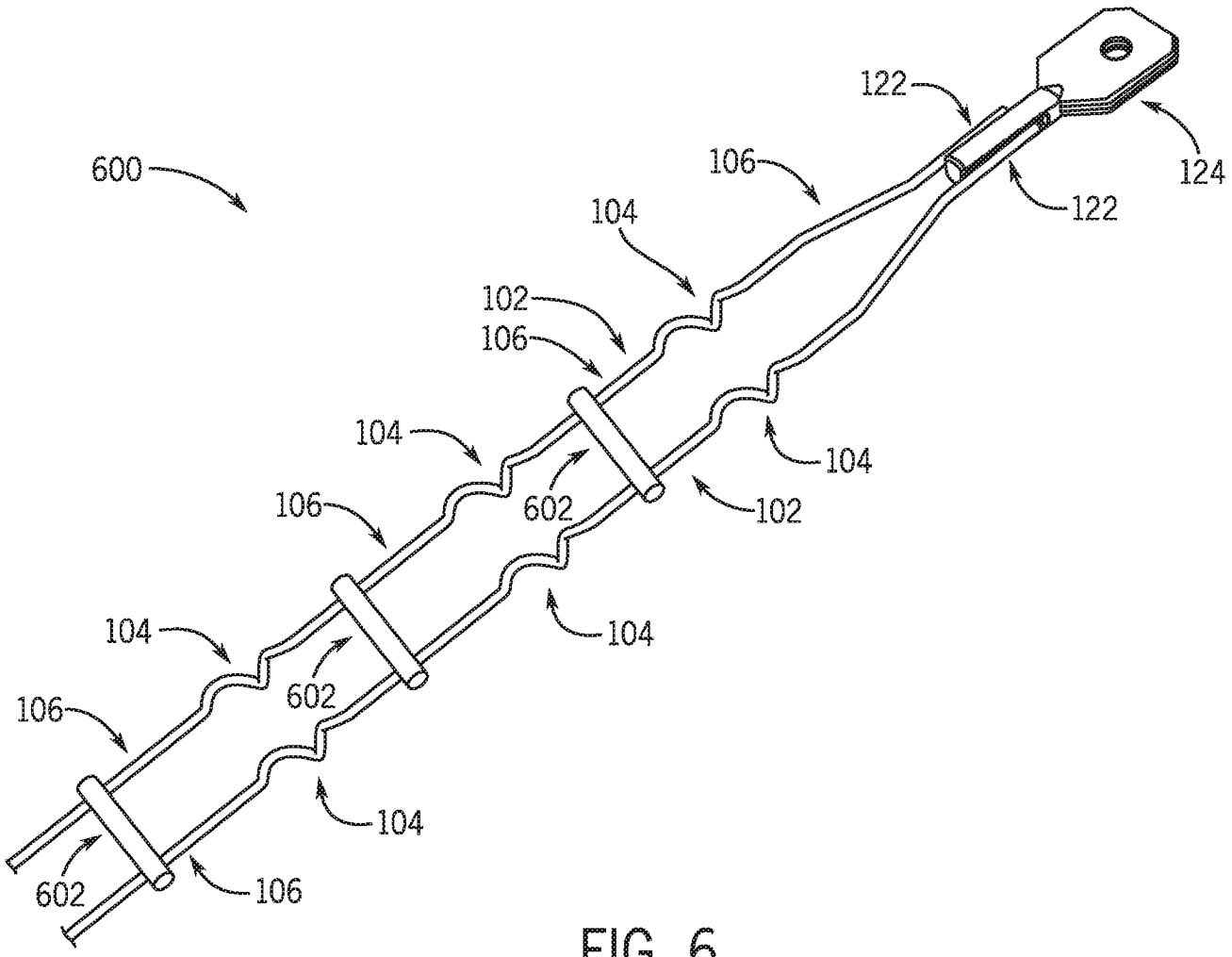
FIG. 6 is a perspective view of a soil reinforcing element for use in a mechanically stabilized earth ("MSE") structure, according to one or more embodiments of the disclosure.

Referring now to FIG. 6, FIG. 6 is a perspective view of a soil reinforcing element 600 for use in a system for constructing an MSE structure, according to one or more embodiments of the disclosure. As the soil reinforcing element 600 may have similar features to the soil reinforcing element 100 of FIGS. 1-3, like numerals will be used to denote like elements, which will not be discussed in detail again for the sake of brevity. The soil reinforcing element 600 may include a plurality of longitudinal wires 102 (two shown) arranged substantially parallel (within +/−10 degrees) with one another. Each longitudinal wire 102 may include one or more helical portions 104 (two shown in each longitudinal wire 102). As shown in FIG. 6, each helical portion 104 may be separated from one another by a linear portion 106 of the longitudinal wire 102. Each linear portion 106 may be straight or substantially straight portion of the longitudinal wire 102 in one or more embodiments.

The soil reinforcing element 600 may further include one or more transverse wires 602 (only one indicated). Each transverse wire 602 may be constructed, for example, from steel or a metal alloy. The longitudinal wires 102 may be joined to the one or more transverse wires 602 in a generally perpendicular fashion by welds at their intersections, thus forming a welded wire gridworks. In exemplary embodiments, the spacing between each longitudinal wire 102 may be about 2 inches (5.08 cm), while spacing between each transverse wire 602 may be about 12 inches (30.48 cm). As can be appreciated, however, the spacing and configuration may vary depending on the mixture of tensile force requirements that the soil reinforcing element 600 is to resist.

In one or more embodiments, lead ends 122 of the longitudinal wires 102 may generally converge toward one another and be welded or otherwise attached to a connection element (e.g., connection stud 124 as shown in FIG. 4 or connection stud 524 as shown in FIG. 5). The lead ends 122 may be coupled or otherwise attached to the stem 126 along at least a portion of the axial length 136 thereof. The grooves 134 defined by the cylindrical body 130 along its axial length 136 may provide a more suitable welding surface for attaching the lead ends 122 of the longitudinal wires 102 (FIGS. 7 and 8) thereto, thereby resulting in a stronger resistance weld. In one or more embodiments, the stem 126 may be omitted from the connection stud, and the lead ends 122 may be coupled directly to the sides of the tab 128.

Figure 7:
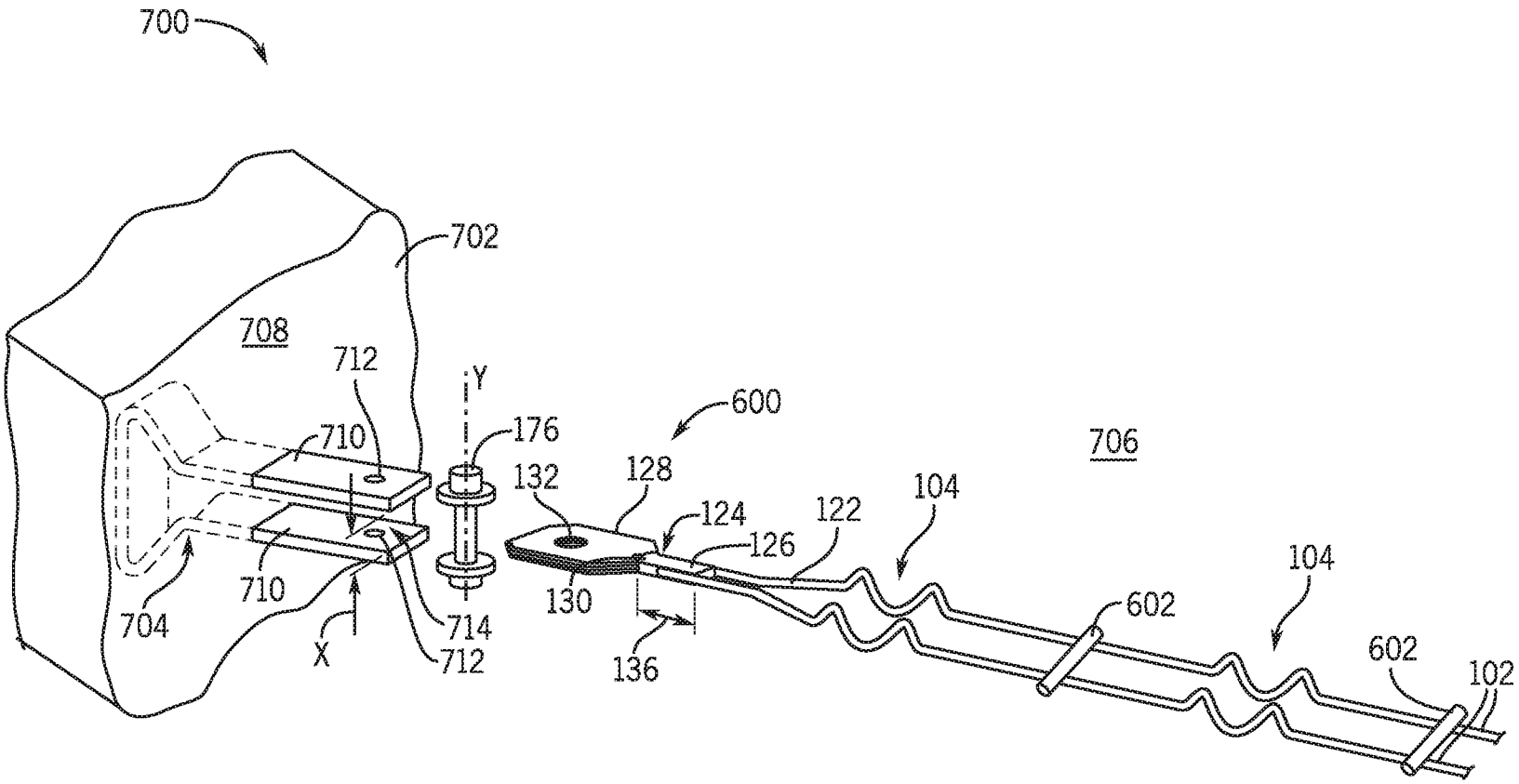
FIG. 7 illustrates a system for constructing an MSE structure, according to one or more embodiments of the disclosure.

FIG. 7 shows a system 700 for constructing an MSE structure, according to one embodiment of the invention. The system 700 may include a facing 702, and at least one soil reinforcing element 100 or 600 and at least one facing anchor 704 to secure an earthen formation or backfill 706 to the facing. The facing 702 may include an individual precast concrete panel or, alternatively, a plurality of interlocking precast concrete modules or wall members that are assembled into an interlocking relationship. In another embodiment, the facing 702 may be a uniform, unbroken expanse of concrete or the like which may be poured or assembled on site. The facing 702 may generally define an exposed face (not shown) and a back face 708. The exposed face typically includes a decorative architectural facing, while the back face 708 is located adjacent the backfill 706. Cast into the facing 702, or otherwise attached thereto, and protruding generally from the back face 708, is at least one facing anchor 704. In some embodiments, instead of being cast into the facing 702, the facing anchor 704 may be mechanically fastened to the back face 708, for example, using bolts (not shown).

The earthen formation or backfill 706 may encompass an MSE structure including a plurality of soil reinforcing elements 100, 600 that extend horizontally into the backfill 706 to add tensile capacity thereto. In an exemplary embodiment, the soil reinforcing elements 100, 600 may serve as tensile resisting elements positioned in the backfill 706 in a substantially horizontal alignment at spaced-apart relationships to one another against the compacted soil. Although illustrated as including a single soil reinforcing element 600, it will be appreciated that the system 700 may include one or more soil reinforcing elements 100, one or more soil reinforcing elements 600, or a combination thereof.

In at least one embodiment, the facing anchor 704 may include a pair of horizontally-disposed connection points or plates 710 cast into and extending from the back face 708 of the facing 702. As can be appreciated, other embodiments include attaching the facing anchor 704 directly to the back face 708, without departing from the disclosure. Furthermore, as can be appreciated, other embodiments of the disclosure contemplate a facing anchor 704 having a single horizontal connection plate 710 (not shown), where the tab 128 is coupled only to the single connection plate 710 via appropriate coupling devices. As will be appreciated, several variations of the facing anchor 704 may be implemented without departing from the scope of the disclosure.

Each plate 710 may include at least one aperture 712 adapted to align with a corresponding aperture 712 on the opposing plate 710. As illustrated in FIG. 7, the plates 710 may be vertically-offset a distance X, thereby generating a gap 714 configured to receive the tab 128 for connection to the anchor 704. In operation, the tab 128 may be inserted into the gap 714 until the hole 132 aligns substantially with the apertures 712 of each plate 710. A coupling device, such as a nut and bolt assembly 716 or the like, may then be used to secure the connection stud 124 (and thus the soil reinforcing element 100 or 600) to the facing anchor 704. In one or more embodiments, the nut and bolt assembly 716 may include a threaded bolt having a nut and washer assembly but can also include a pin-type connection having an end that prevents it from removal, such as a bent-over portion.

In this arrangement, the soil reinforcing element 100 or 600 (as coupled to the connection stud 124) may be allowed to swivel or rotate about axis Y in a horizontal plane Z. Rotation about axis Y may prove advantageous since it allows the system 700 to be employed in locations where a vertical obstruction, such as a drainage pipe, catch basin, bridge pile, bridge pier, or the like may be encountered in the backfill 706. To avoid such obstructions, the soil reinforcing element 100 or 600 may be pivoted about axis Y to any angle relative to the back face 706, thereby swiveling to a position where no obstacle exists.

Moreover, the gap 714 defined between two vertically-offset plates 710 may also prove significantly advantageous. For example, the gap 714 may compensate or allow for the settling of the MSE structure as the soil reinforcing element 100 or 600 settles in the backfill 706. During settling, the tab 128 may be able to shift or slide vertically about the nut and bolt assembly 716 the distance X, thereby compensating for a potential vertical drop of the soil reinforcing element 100 or 600 and preventing any buckling of the concrete facing 702. As will be appreciated by those skilled in the art, varying designs of facing anchors 704 may be used that increase or decrease the distance X to compensate for potential settling or other MSE mechanical phenomena.

Furthermore, it is not uncommon for concrete facings 702 to shift in reaction to MSE settling or thermal expansion/contraction. In instances where such movement occurs, the soil reinforcing elements 100 or 600 of the disclosure are capable of correspondingly swiveling about axis Y and shifting the vertical distance X to prevent misalignment, buckling, or damage to the concrete facing 702.

Figure 8:
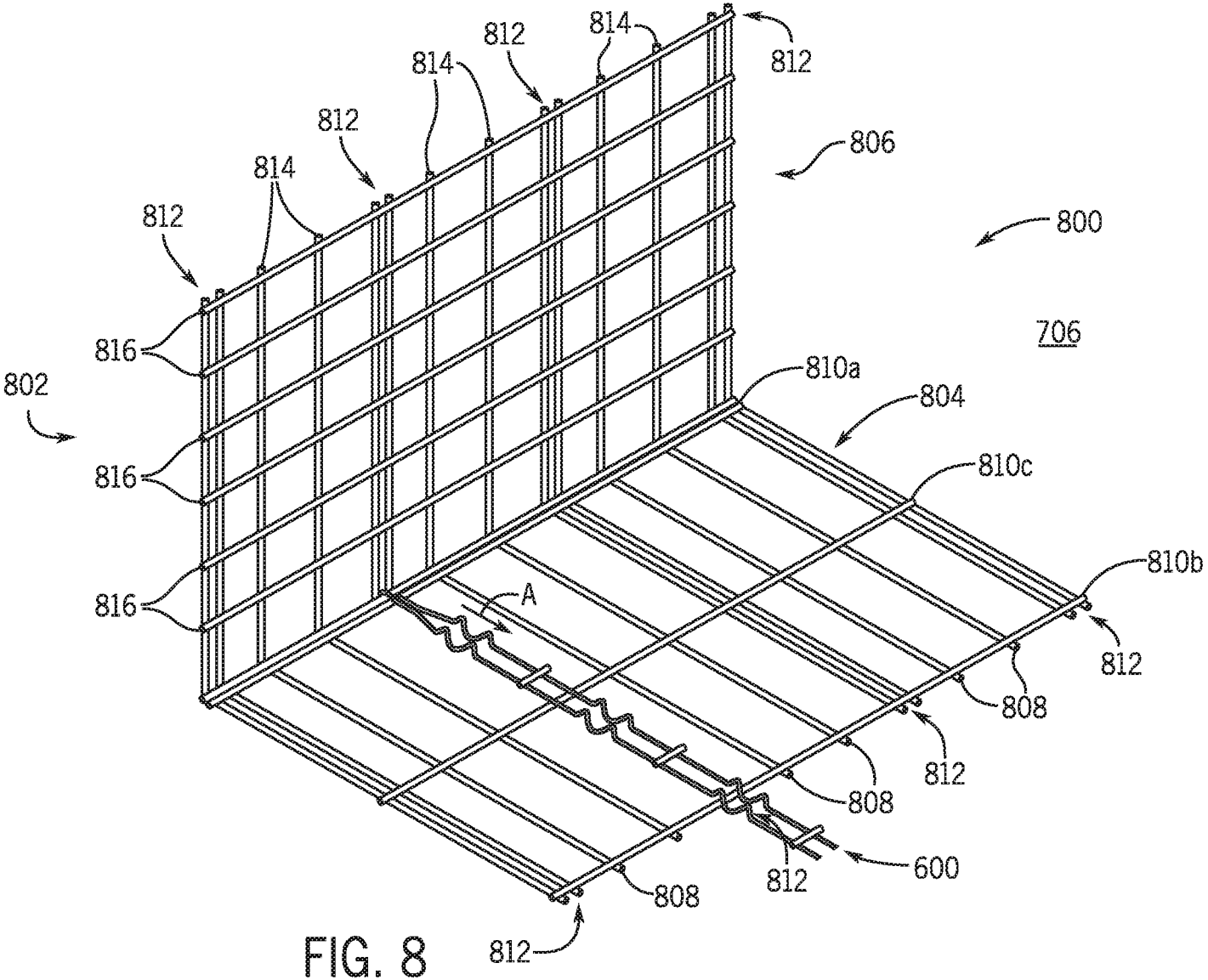
FIG. 8 illustrates a system for constructing an MSE structure, according to one or more embodiments of the disclosure.

FIG. 8 shows another system 800 for constructing an MSE structure, according to one embodiment of the invention. The system 800 may include a facing 802 and at least one soil reinforcing element 100 or 600 to secure an earthen formation or backfill 706 to the facing. The facing 802 may be wire facing fabricated from several lengths of cold drawn wire welded and arranged into a mesh panel. The wire mesh panel can then be folded to form a substantially L-shaped structure including a horizontal facing portion 804 and a vertical facing portion 806. The horizontal facing portion 804 may include a plurality of horizontal wires 808 welded or otherwise attached to one or more cross wires 810*a-c*. In the illustrated exemplary embodiment, the cross wires 810*a-c* may include an initial wire 810*a* and a terminal wire 810*b*. The initial wire 810*a* may be disposed adjacent to and directly behind the vertical facing portion 806, thereby being positioned inside the MSE structure. The terminal wire 810*b* may be disposed at or near the distal ends of the horizontal wires 808. The horizontal facing portion 804 may further include other wires disposed between the initial and terminal wires 810*a,b*, such as a median wire 810*c*.

As depicted in FIG. 8, a plurality of connector leads 812 may be equidistantly spaced from each other along the horizontal facing portion 804 and configured to provide a visual indicator to an installer as to where a soil reinforcing element 100 or 600 may be properly attached, as will be described in greater detail below. In an embodiment, each connector lead 812 may be a pair of horizontal wires 808 laterally offset from each other by a short distance, such as about 1 inch (2.54 cm). While the horizontal wires 808 adjacent the connector leads 812 may be generally spaced from each other by about 4 inches (10.16 cm) on center, each connector lead 812 may be spaced from each other by about 12 inches (30.48 cm) on center. As can be appreciated, however, such distances may vary to suit particular applications dependent on varying stresses inherent in MSE structures.

The vertical facing portion 806 can include a plurality of vertical wires 814 extending vertically with reference to the horizontal facing portion 804 and equidistantly spaced from each other. In one embodiment, the vertical wires 814 may be vertical extensions of the horizontal wires 808 of the horizontal facing portion 804. Furthermore, the connector leads 812 from the horizontal facing portion 804 may also extend vertically into the vertical facing portion 806. The vertical facing portion 806 may also include a plurality of facing cross wires 816 vertically offset from each other and welded or otherwise attached to both the vertical wires 814 and vertical connector leads 812. In at least one embodiment, the vertical wires 814 may be equidistantly separated by a distance of about 4 inches (10.16 cm) and the facing cross wires 816 may be equidistantly separated from each other by a distance of about 4 inches (10.16 cm), thereby generating a grid-like facing composed of a plurality of square voids having a 4"×4" dimension. As can be appreciated, however, the spacing between adjacent wires 814, 816 can be varied to more or less than 4 inches (10.16 cm) to suit varying applications.

In one or more embodiments, the cross wires 810*a-c* of the horizontal facing portion 804 may be larger in diameter than the cross wires 816 of the vertical facing portion 806. This may prove advantageous since the soil reinforcing elements 100 or 600 may be coupled or otherwise attached to the cross wires 810*a-c* where greater weld shear force is required and can be attained. In at least one embodiment, the cross wires 810 *a-c* of the horizontal facing portion 804 may be at least twice as large in diameter as the facing cross wires 816 of the vertical facing portion 806. In other embodiments, however, the diameter of each plurality of cross wires 810*a-c*, 816 may be substantially the same or the facing cross wires 816 may be larger than the cross wires 810*a-c* of the horizontal facing portion 804 without departing from the scope of the disclosure.

In exemplary operation, as depicted in FIG. 8, soil reinforcing element 600 may be coupled to the facing 802 by coupling the connection stud 524 to the initial wire 810*a*. Although illustrated as including a single soil reinforcing element 600, it will be appreciated that the system 800 may include one or more soil reinforcing elements 100, one or more soil reinforcing elements 600, or a combination thereof. The connector 528 may be coupled or otherwise "hooked" to the initial wire 810*a*, thereby preventing its removal therefrom in a first direction indicated by arrow A. In some embodiments, one or more of the soil reinforcing elements 100 or 600 may further be attached to the facing 802 at one or more of the connector leads 812 of the horizontal facing portion 804.

As can be appreciated, the reduced spacing between the pair of horizontal wires 808 that make up each connector lead 812 may provide a structural advantage. For instance, the reduced spacing may generate an added amount of weld shear resistance where the connector 528 hooks onto the initial wire 810*a*. Also, the reduced spacing may generate a stronger initial wire 810*a* that is more capable of resisting bending forces when stressed by the pulling of the connector 528.

Further, it will be appreciated that the system 800 may include a facing anchor (not shown) in some embodiments capable of coupling one or more soil reinforcing elements 100, 600 to the facing 802. In such embodiments, the facing anchor may couple the one or more soil reinforcing elements 100, 600 to the horizontal facing portion 804, the vertical facing portion 806, or both the horizontal facing portion 804 and the vertical facing portion 806.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A soil reinforcing element for use in a mechanically stabilized earth structure, comprising:

a longitudinal wire comprising a plurality of helical portions, including a first helical portion, the plurality of helical portions separated by a linear portion and the longitudinal wire configured to couple at a first end to a facing of the mechanically stabilized earth structure, wherein the plurality of helical portions are to be embedded in soil to reinforce the soil and allow for a decreased force within the soil relative to the mechanically stabilized earth structure.

2. The soil reinforcing element of claim 1, wherein the longitudinal wire further comprises at least one linear portion coupled to or integral with the first helical portion.

3. The soil reinforcing element of claim 2, wherein the linear portion is welded to the first helical portion.

4. The soil reinforcing element of claim 1, wherein the first helical portion includes a first center axis and one or more coils formed from a curvature of the longitudinal wire about the first center axis.

5. The soil reinforcing element of claim 4, wherein the plurality of helical portions further comprise a second helical portion including a second center axis and one or more coils formed from a curvature of the longitudinal wire about the second center axis of the second helical portion.

6. The soil reinforcing element of claim 5, wherein a first itch of one coil of the first helical portion is different from a second pitch of one coil of the second helical portion.

7. The soil reinforcing element of claim 5, wherein a first outer diameter of one coil of the first helical portion is different from a second outer diameter of one coil of the second helical portion.

8. The soil reinforcing element of claim 1, wherein the the plurality of helical portions separated by a linear portion extend from the first end of the longitudinal wire to a second end of the longitudinal wire.

9. The soil reinforcing element of claim 1, wherein the longitudinal wire further comprises a connection element disposed at the first end of the longitudinal wire and configured to couple to a facing of the mechanically stabilized earth structure.

10. A soil reinforcing element for use in a mechanically stabilized earth structure, comprising:

a first longitudinal wire including a first plurality of helical portions, including a first helical portion, the first plurality of helical portions separated by a first linear portion of the first longitudinal wire;

a second longitudinal wire disposed substantially parallel to the first longitudinal wire and including a second plurality of helical portions, including a second helical portion, the second plurality of helical portions separated by a second linear portion of the second longitudinal wire;

a plurality of transverse wires disposed substantially perpendicular to and coupled to the first longitudinal wire and the second longitudinal wire; and a connection element disposed at a first end of each of the first longitudinal wire and the second longitudinal wire and configured to couple to a facing of the mechanically stabilized earth structure, wherein the first and second plurality of helical portions are to be embedded in soil to reinforce the soil and allow for a decreased force within the soil relative to the mechanically stabilized earth structure.

11. The soil reinforcing element of claim 10, wherein:

the connection element includes a stem defining a plurality of grooves; and the first ends of the first longitudinal wire and the second longitudinal wire are resistance welded to the stem.

12. The soil reinforcing element of claim 10, wherein the first longitudinal wire and the second longitudinal wire each further comprise at least one linear portion coupled to or integral with an initial helical portion of each respective longitudinal wire.

13. The soil reinforcing element of claim 10, wherein an initial helical portion of each of the first longitudinal wire and the second longitudinal wire includes a center axis and one or more coils formed from a curvature of the respective first and second longitudinal wires about the center axis.

14. The soil reinforcing element of claim 13, wherein each of the first longitudinal wire and the second longitudinal further comprises a secondary helical portion after the initial helical portion, the secondary helical portion including a center axis and one or more coils formed from a curvature of the respective first and second longitudinal wires about the center axis of the secondary helical portion.

15. The soil reinforcing element of claim 14, wherein a first pitch of one coil of the initial helical portion of the first longitudinal wire is different from a second pitch of one coil of the secondary helical portion of the first longitudinal wire.

16. The soil reinforcing element of claim 14, wherein a first pitch of one coil of the first longitudinal wire is different from a second pitch of one coil of the second longitudinal wire.

17. The soil reinforcing element of claim 14, wherein a first outer diameter of one coil of the initial helical portion of the first longitudinal wire is different from a second outer diameter of one coil of the secondary helical portion of the first longitudinal wire.

18. The soil reinforcing element of claim 14, wherein a first outer diameter of one coil of the first longitudinal wire is different from a second outer diameter of one coil of the second longitudinal wire.

19. A system for constructing a mechanically stabilized earth structure, comprising:

a facing; and a soil reinforcing element configured to extend from the facing into a backfill, the soil reinforcing element comprising a longitudinal wire including:

a plurality of helical portions separated by a linear portion, the plurality of helical portions including a first helical portion; and a connection element disposed at a first end of the longitudinal wire and configured to couple to the facing of the mechanically stabilized earth structure, wherein the plurality of helical portions are to be embedded in soil to reinforce the soil and allow for a decreased force within the soil relative to the mechanically stabilized earth structure.

20. The system of claim 19, wherein the facing is constructed from one or more concrete panels, and the system further comprises a facing anchor coupled to the facing and the connection element, thereby coupling the soil reinforcing element to the facing.

21. The system of claim 19, wherein the facing is constructed from a wire mesh having an L-shape and including a horizontal facing portion and a vertical facing portion, and the connection element is coupled to the facing such that the soil reinforcing element is disposed on the horizontal facing portion and is coupled to the facing.

* * * * *